United States Patent [19]

Whitman

[11] Patent Number: 4,945,691

[45] Date of Patent: Aug. 7, 1990

[54] DEVICE FOR SECURING ROOF COVERINGS ON BUILDINGS

[76] Inventor: Robert E. Whitman, 2465 Knightshill, Toledo, Ohio 43614

[21] Appl. No.: 267,505

[22] Filed: Nov. 4, 1988

[51] Int. Cl.[5] ..... E04D 5/00

[52] U.S. Cl. ..... 52/23; 52/408

[58] Field of Search ..... 52/408, 23, 24, 3, 222, 52/199

[56] References Cited

U.S. PATENT DOCUMENTS

| | | | |
|---|---|---|---|
| 3,828,498 | 8/1974 | Jones | 52/24 |
| 3,828,501 | 8/1974 | Haskins | 52/23 |

FOREIGN PATENT DOCUMENTS

| | | | |
|---|---|---|---|
| 70585 | 2/1950 | Denmark | 52/408 |
| 8200364 | 9/1983 | Netherlands | 52/408 |

*Primary Examiner*—James L. Ridgill, Jr.
*Attorney, Agent, or Firm*—George R. Royer

[57] ABSTRACT

The invention herein is directed to an improved apparatus used for facilitating the process of securing roof coverings, such as rubber roof sheets to the upper surface of a roof deck, particularly on high-rise buildings. The subject apparatus is adapted to directly and simply weigh down, by its own weight alone, portions of the upper surface area of a roof covering sheet so that the covering sheet cannot be blown up and away from the roof deck. The structure encompassed herein includes an open box-like container, with individual vertically disposed compartments. These latter compartments are adapted to contain cement, stones or other heavy fill so as to cause the filled structure to be heavy enough to weigh down the roof covering.

1 Claim, 1 Drawing Sheet

FIG.1
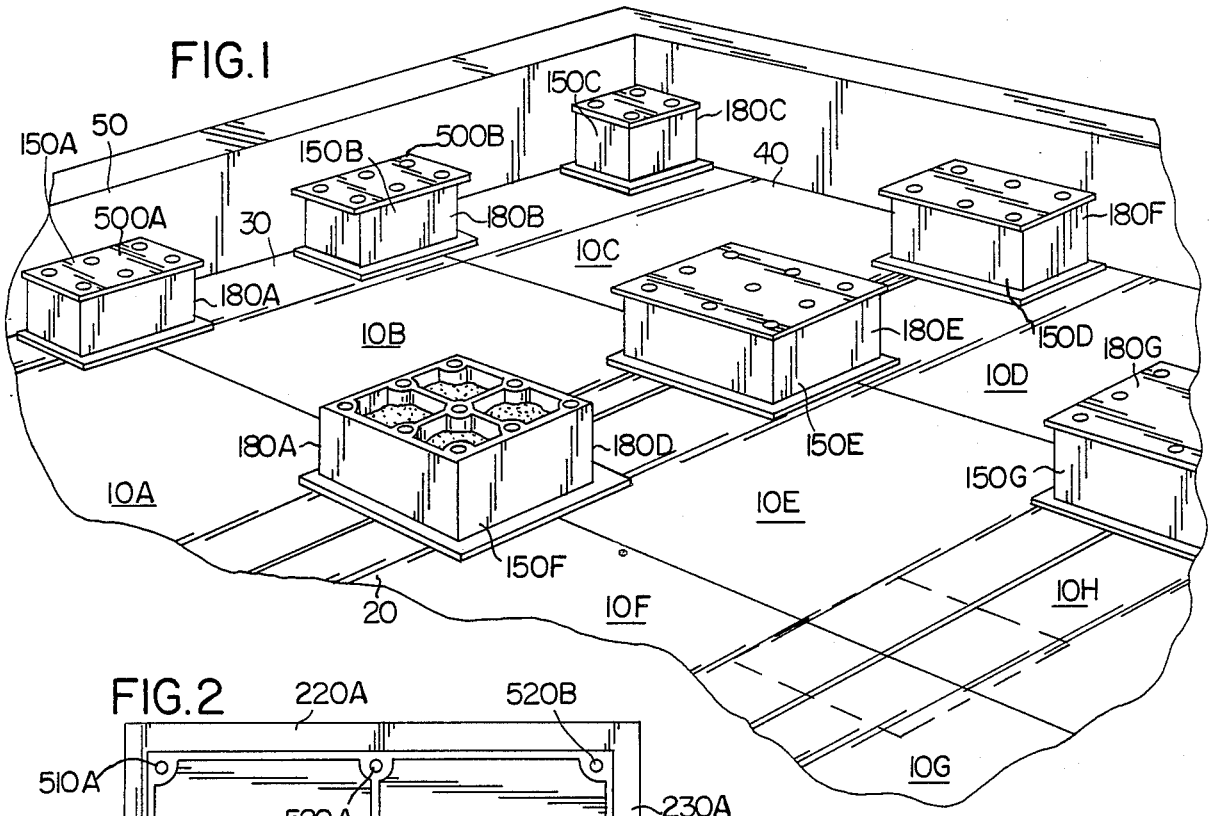
FIG.2
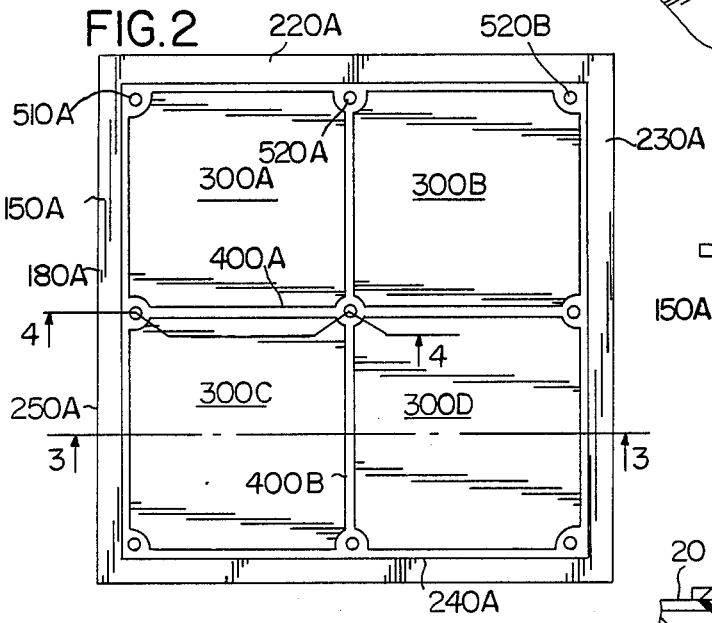
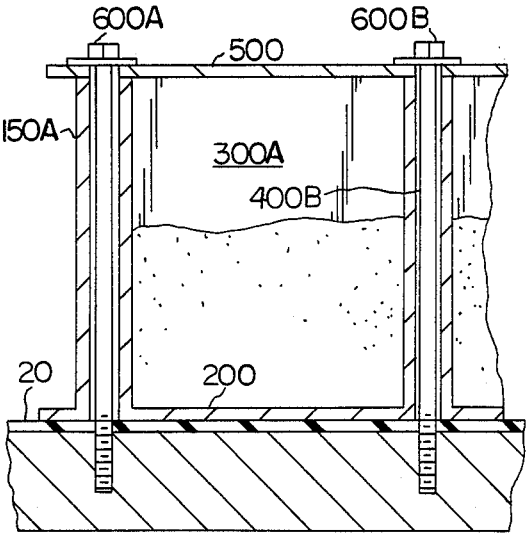
FIG.4
FIG.3
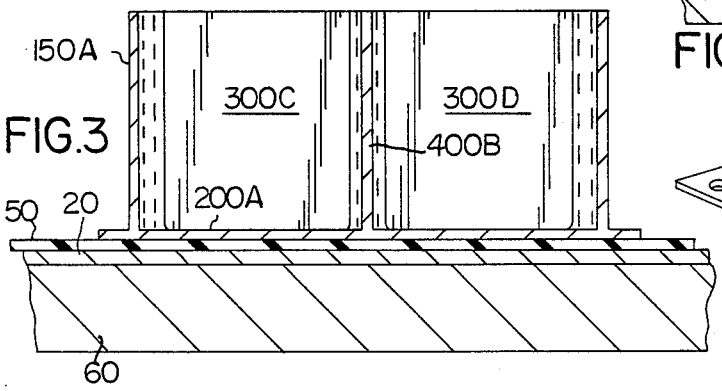
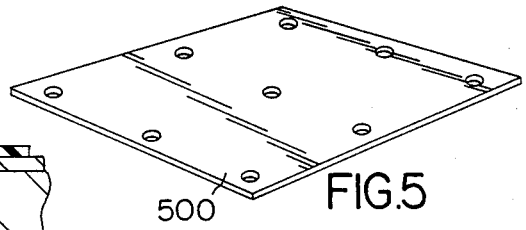
FIG.5

DEVICE FOR SECURING ROOF COVERINGS ON BUILDINGS

BACKGROUND OF INVENTION AND DESCRIPTION OF PRIOR ART

The invention herein pertains to an apparatus for helping secure rectangularly shaped sheets of rubber roofing to the upper surface of a roof. Roofing sheets comprised of rubber materials are now used more widely for roof coverings because of the attendant optimal life and durability. The usual approach in high-rise buildings is to place over the upper roof surface a grid-like pattern of rubber roof sheets, dispersed evenly and fully over the upper roof surface. The problems encountered in high-rise buildings is that high winds tend to readily lift roof coverings and blow them out of place or off the roof. This aspect requires special means, such as weighing down by substantial means the roof covering as opposed to conventional fastening arrangement. In most high-rise building applications the rubber roof sheets are usually merely weighted down in a flush manner by stone fill adhered evenly over the roof surface. The more common practice is to disperse stones over the upper surface of the rubber roof sheets to help keep the respective rubber roof sheets in place over the upper roof deck.

One of the predominant problems with using the latter method is that stones do not provide an optimal sealing, and water leakage is not uncommon into the roof deck and below. Frequently water leakage occurs at the point where a roof sheet abuts the edge of another, and some effective device is needed to fully maintain such rubber roof sheets in a weighted down condition.

The subject invention is conceived to overcome such problems in the prior art and the following objects of the subject invention are set forth accordingly.

OBJECTS

In view of the above, it is an object of the subject invention to provide an improved apparatus for affixing rubber roofing sheets to the upper surface of a roof;

Yet another object of the subject invention is to provide an improved device for maintaining rubber roof sheets for covering roof structures in a high-rise building application;

Still another object of the subject invention is to provide an improved device for adhering and affixing rubber roof sheets to the upper surface of a roof;

Still another object of the subject invention is to provide an effective device to cover roof structures.

Other and further objects of the subject invention will become apparent from a reading of the following description taken in conjunction with the claims.

DESCRIPTION OF DRAWINGS

FIG. 1 is an upper perspective view of the devices utilizing the invention herein, as emplaced over the upper surface of a roof structure;

FIG. 2 is a top elevational view of the subject device;

FIG. 3 is a side perspective view of the subject device demonstrating how it is applied;

FIG. 4 is a perspective view of the inner compartmentalized lining devices, as used in the subject device.

DESCRIPTION OF GENERAL EMBODIMENT

The invention herein is directed to an improved apparatus used for facilitating the process of securing roof coverings, such as rubber roof sheets to the upper surface of a roof deck, particularly on high-rise buildings. The subject apparatus is adapted to directly and simply weigh down, by its own weight alone, portions of the upper surface area of a roof covering sheet so that the covering sheet cannot be blown up and away from the roof deck. The structure encompassed herein includes an open box-like container, with individual vertically disposed compartments. These latter compartments are adapted to contain cement, stones or other heavy fill so as to cause the filled structure to be heavy enough to weigh down the roof covering.

DESCRIPTION OF PREFERRED EMBODIMENT

The subject invention centers on a phYsical apparatus for process of holding down a plurality of rubber roof sheets to the upper surface of a roof of any type of building structure. However, the preferred embodiment of the subject invention is most applicable to roof structures wherein the roof is a horizontal roof at the top of a high-rise building. Moreover, description and application of the preferred embodiment is not to be considered as limiting the scope of the subject invention.

Turning now to the drawings, the subject invention involves an apparatus to aid in the process of holding down roof sheets 10A, 10B.... to a roof such as roof deck 20 shown in FIGS. 1 and 3. In this respect, the roof deck 20 is a horizontal, flat structure having perimeter edges, with respective edges 30 and 40 as shown. Such roof deck 20 is considered conventional in this regard, however, the subject invention can apply to a roof of any external configuration, whether rectangular, flat or other structural shape, but its most particularly application is to high-rise roofs, such as roof 20.

As a preliminary consideration in the process of affixing rubber roof sheets to roof deck 20, the first step in the process, particularly in high-rise structures such as building 50 on which roof deck 20 is located, is to lay a flat layer of insulation 60 over the upper surface 65 of the roof deck 20, as shown in FIG. 3. In most structural arrangements the insulation layer is layered over the upper surface of the roof deck 20, although this latter arrangement is not critical. The next step is to place over the insulation layer 60 a plurality of rectangular shaped rubber roof sheets, such as sheet 10A, shown in FIG. 3. As seen, the roofing sheets 10A, 10B.... are affixed in a grid-like pattern so that all such sheets cover the entire roof surface in a conforming and full manner, in the matrix-like, end-to-end pattern shown in FIG. 1. Next, a plurality of weighted members 150A, 150B are placed over the upper surface of the rubber roof sheets 10A, 10B...., generally and preferably placed in a series of evenly-spaced rows and columns, in a grid-like pattern, as seen from an upper elevational view of FIG. 1. These weighted members function to secure the rubber roof sheets 10A, 10B.... to the upper surface of the roof deck 20.

As stated previously, it is not critical to the subject invention that the weighted members 150A, 150B be affixed in a regular pattern, however. Particularly, in the preferred embodiment shown the weighted members are spaced a horizontal distance from one another of several feet. These distances are considered optional and are not critical to the subject invention, however, but are described and illustrated to demonstrate the matrix-like grid over which the weighted members are dispersed.

More particularly, the weighted members 150A, 150B incorporating the subject invention are deployed by placing them over the surfaces of the rubber roof sheets 10A, 10B....once they are emplaced over the roof surface 20 and usually and preferably the weighted devices are placed over the intersecting edges of adjoining rubber roof sheets as shown in FIG. 1. By being so placed over the top of the rubber roof sheets 10A, 10B.... the weighted devices cover only a portion of the rubber roof sheet, as shown in FIG. 3. The weighted member 150 is simply emplaced over the top of the rubber roof sheet 10A, 10B... and its weight holds down the rubber roof sheet 10A, as shown.

Referring specifically to FIGS. 2, 3 and 4, the weighted device 150A incorporating the features of the subject invention is a horizontal box-like structure 180A having a bottom 200 and four vertically disposed outer sides 220A, 230A, 240A and 250A. The top of such box-like structure 180A is open and may have a plurality of individualized vertically disposed compartments 300A, 300B, 300C and 300D, which are formed by vertical intersecting devices 400A and 400B. In the preferred embodiment of the subject invention the box-like member is formed of metal with welded edges. Once the compartments are arranged, cement or stone is used to fill the compartments to augment the weight of the box 180A. This helps substantially in the holding function.

In the preferred and basic embodiment of the subject invention, as shown in the drawings, a weigh-down device 180A is shown, which device comprises in general a base bottom container 200A and a top covering 500 that is adapted to fit conformingly over the top of the weigh down member 180A in order to cover the weigh down member 500, as shown in FIG. 1.

I claim:

1. A device securing and holding roof covers to the upper surface of a roof structure comprising:

(a) a lower container member with an open top with said lower container member having a plurality of vertically disposed compartments therein, which compartments are adapted to receive fill material and wherein said lower container member has a plurality of vertical openings extending all the way through such container;

(b) an upper covering member an upper and lower surface, which upper covering member fits conformingly over the open top of such lower container member, wherein said upper covering member has a plurality of vertically disposed openings that hold vertically disposed fastening rods and wherein such vertically disposed fastening rods extend vertically downwardly from the lower surface of said upper cover member and further extend completely through the vertical openings in the lower container member, thereby fastening the upper cover member and the lower container member as a unit to the upper surface of such roof structure.

* * * * *